US011046477B2

(12) United States Patent
Wisecarver et al.

(10) Patent No.: US 11,046,477 B2
(45) Date of Patent: Jun. 29, 2021

(54) LEAK PROOF CONTAINER WITH ADHESIVE ATTACHMENT

(71) Applicant: INTERNATIONAL PAPER COMPANY, Memphis, TN (US)

(72) Inventors: Mark Anthony Wisecarver, Morristown, TN (US); James William Sloan, II, Edgefield, SC (US); Kenneth Calvin Hyatt, Springdale, AR (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/572,768

(22) Filed: Sep. 17, 2019

(65) Prior Publication Data

US 2021/0078757 A1 Mar. 18, 2021

(51) Int. Cl.

| | |
|---|---|
| ***B65D 5/42*** | (2006.01) |
| ***B65D 5/24*** | (2006.01) |
| ***B65D 5/28*** | (2006.01) |
| ***B31B 70/62*** | (2017.01) |
| ***B31B 70/00*** | (2017.01) |
| ***B31B 70/04*** | (2017.01) |
| ***B31B 70/26*** | (2017.01) |

(52) U.S. Cl.

CPC ..... *B65D 5/4279* (2013.01); *B31B 70/006* (2017.08); *B31B 70/04* (2017.08); *B31B 70/26* (2017.08); *B31B 70/62* (2017.08); *B65D 5/244* (2013.01); *B65D 5/28* (2013.01); *B65D 5/4266* (2013.01)

(58) Field of Classification Search

CPC ..... B65D 5/4279; B65D 5/244; B65D 5/28; B65D 5/4266; B65D 5/248

USPC ..... 229/190, 186, 171, 5.84, 132, 122.32, 229/180

See application file for complete search history.

(56) References Cited

U.S. PATENT DOCUMENTS

| | | | | | |
|---|---|---|---|---|---|
| 2,859,906 | A | * | 11/1958 | Guyer | B65D 5/248 229/175 |
| 2,909,105 | A | * | 10/1959 | Lawrence | B31B 50/00 493/137 |
| 3,670,881 | A | * | 6/1972 | Dutcher | B65D 5/248 229/125.015 |
| 5,217,159 | A | * | 6/1993 | Calvert | B29C 66/1122 229/136 |
| 5,415,340 | A | * | 5/1995 | Calvert | B65D 5/563 229/5.84 |

(Continued)

*Primary Examiner* — Christopher R Demeree
(74) *Attorney, Agent, or Firm* — Michael D. Folkerts; Thomas W. Ryan

(57) ABSTRACT

A leak proof container and a method of forming the container from a blank. The blank includes a bottom panel, first and second side panels connected to the bottom panel at opposing lateral edges, and first and second end portions located at opposing longitudinal ends of the blank. Each end portion includes an inner end panel connected to the bottom panel, an outer end panel connected to the inner end panel, and first and second corner panels forming gussets connected to a respective one of the first and second side panels and connected to the inner end panel. An adhesive area is located on one side of the blank and comprises at least a portion on each of the outer end panel and the inner end panel. The adhesive area adheres the gussets to the inner end panel and to the outer end panel.

12 Claims, 3 Drawing Sheets

(56) References Cited

U.S. PATENT DOCUMENTS

| | | | | |
|---|---|---|---|---|
| 10,577,145 | B2 * | 3/2020 | Bevier | B65D 5/40 |
| 2016/0001917 | A1 * | 1/2016 | Gould | B65D 77/003 229/171 |

* cited by examiner

LEAK PROOF CONTAINER WITH ADHESIVE ATTACHMENT

FIELD OF THE INVENTION

The present disclosure relates to containers or trays formed from a blank of material and, more particularly, to a container that is formed with a leak proof construction for retaining moisture or fluid within the container.

BACKGROUND OF THE INVENTION

In some applications of containers or trays formed of folded material such as paperboard material, e.g., corrugated paperboard, the container or tray may be configured to receive products having moisture or a fluid content that can leak into a base portion of the container or tray. In a known use of a container, a package containing protein parts of poultry may be supported within the container and the container can prevent leakage of fluids outside of the container.

For example, one known type of container can be formed from a blank of corrugated material wherein a bottom panel and a plurality of side panels may be formed of a unitary construction from a die cut and scored sheet of material. It is also known to provide such a container construction wherein the corners adjacent to the bottom are sealed. In such a container construction, the side panels can be integrally connected to the bottom panel along respective fold lines, and adjacent side panels can be connected by a folded gusset or web that is disposed at each corner to essentially configure the corners as leak proof connections between panels. While such container constructions can facilitate containing and handing of food products, such as in a food processing plant, one known problem that may be associated with leakproof containers is the potential of foreign object contamination. For example, in production processes for corrugated container blanks configurated and used for forming current leakproof containers, there is potential for corrugated trim to remain attached to the container blank. Hence, there remains a possibility that trim debris may release from a container to contaminate the container contents, such as when containers are assembled manually or mechanically and/or when containers are positioned in close relation to each other as trim falls in between stacked containers during manufacturing, wherein the trim can find its way into assembled boxes filled with product.

SUMMARY OF THE INVENTION

In accordance with an aspect of the invention, a blank for making a leak proof container is described. The blank comprises a bottom panel having a plurality of peripheral edges. First and second side panels are connected to the bottom panel at opposing lateral peripheral edges and define lower edges of the container. First and second end portions are located at opposing longitudinal ends of the blank. Each end portion includes an inner end panel connected to a longitudinal peripheral edge of the bottom panel, an outer end panel having an inner longitudinal edge hingedly connected to a longitudinal edge of the inner end panel, first and second corner panels, each corner panel having a longitudinal edge connected to a respective one of the first and second side panels and a lateral edge connected to a lateral edge of the inner end panel. An adhesive area is located on one side of the blank and comprises at least a portion on each of the outer end panel and the inner end panel.

The adhesive area may extend longitudinally generally continuously from the outer end panel to the inner end panel.

The adhesive area may comprise first and second laterally spaced adhesive areas.

The first and second adhesive areas may include outer lateral edges located adjacent to respective lateral edges of the outer end panels and adjacent to respective lateral edges of the inner end panels.

The adhesive areas may each include an inner lateral edge, parallel to the outer lateral edges of the adhesive areas, and an inner longitudinal edge having at least a portion defining an angled corner forming an obtuse angle extending from a respective inner lateral edge.

The first and second adhesive areas may extend longitudinally generally continuously from the outer end panel to the inner end panel.

The adhesive areas may be defined by an application of hot melt glue.

The corner panels may be formed as square panels, and may include a diagonal fold line dividing each corner panel into first and second triangular gusset panels.

Each corner panel may include a lateral edge that is colinear with a lateral edge of the blank defined by an edge of one of the first and second side panels.

A longitudinal dimension of the outer end panel may be substantially less than a longitudinal dimension of the inner end panel.

The adhesive area may be located on the outer side of the blank.

The adhesive area may be located on the inner side of the blank.

In accordance with another aspect of the invention, a container is provided including a bottom panel defining a bottom of the container and having a plurality of peripheral edges. First and second side panels are connected to the bottom panel at opposing lateral peripheral edges and folded upward relative to the bottom panel. First and second end portions are located at opposing longitudinal ends of the blank. Each end portion includes an inner end panel connected to a longitudinal peripheral edge of the bottom panel, an outer end panel having an inner longitudinal edge hingedly connected to a longitudinal edge of the inner end panel, first and second corner panels, each corner panel including longitudinal and lateral edges connected to respective edges of a side panel and the inner end panel, each corner panel folded about a diagonal gusset fold line to define a gusset, and each gusset folded perpendicular to a respective side panel to overlapping relationship with the inner end panel, First and second laterally spaced adhesive areas, comprising at least a portion of each of the areas located on each of the outer end panel and the inner end panel, wherein the outer end panel is folded about the inner longitudinal edge to overlapping relationship with at least a portion of each of the gussets.

The first and second adhesive areas may extend generally continuously from the outer end panel to the inner end panel.

Each adhesive area may extend between a respective gusset and the inner end panel to adhere the gussets to the inner end panel.

Each adhesive area may extend between a respective gusset and the outer end panel to adhere the gussets to the outer end panel.

The gusset fold line may extend from the bottom of the container to the inner longitudinal edge of the outer end panel.

The outer longitudinal edge of the outer end panel may be located in spaced relation from the bottom of the container.

The adhesive areas may be defined by an application of hot melt glue.

The gussets may be located in overlapping relationship with an outer side of the inner end panel.

The gussets may be located in overlapping relationship with an inner side of the inner end panel.

The adhesive areas may extend across substantially an entire area of the inner end panel that is overlapped by the gussets.

In accordance with a further aspect of the invention, a method of forming a container from a blank is provided. The blank comprises a bottom panel having a plurality of peripheral edges, first and second side panels connected to the bottom panel at opposing lateral peripheral edges and defining lower edges of the container, first and second end portions located at opposing longitudinal ends of the blank, each end portion including an inner end panel connected to a longitudinal peripheral edge of the bottom panel, an outer end panel having an inner longitudinal edge hingedly connected to a longitudinal edge of the inner end panel, first and second corner panels, each corner panel having a longitudinal edge connected to a respective one of the first and second side panels and a lateral edge connected to a lateral edge of the inner end panel. The method includes forming an end portion of the container comprising: applying an adhesive material to form an adhesive area located on the outer side of the blank and comprising at least a portion on each of the outer end panel and the inner end panel; folding the side panels and inner end panel upward from the bottom panel, and simultaneously folding each corner panel about a diagonal gusset fold line to define a gusset; folding each gusset perpendicular to a respective side panel to overlapping relationship with the inner end panel and into engagement with the adhesive area; and folding the outer end panel about the inner longitudinal edge of the outer end panel to position the adhesive area in engagement with at least a portion of each of the gussets.

The adhesive area may comprise first and second laterally spaced adhesive areas formed as strips adjacent to opposing lateral edges of the outer and inner end panels.

The first and second adhesive areas may extend generally continuously from the outer end panel to the inner end panel.

The adhesive area may be defined by an application of hot melt glue.

The gussets may be folded to overlapping relationship with an outer side of the inner end panel.

The gussets may be folded to overlapping relationship with an inner side of the inner end panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
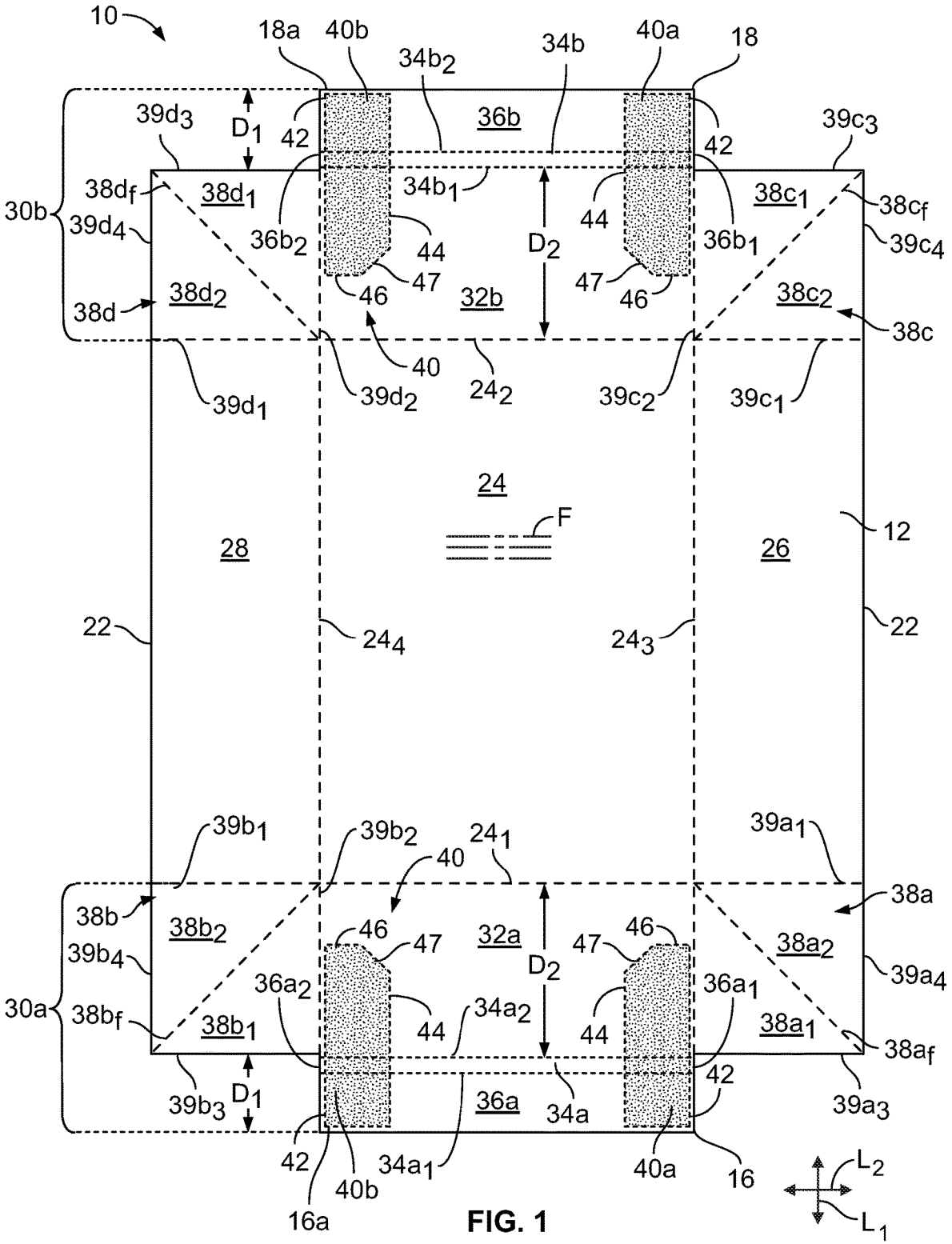
FIG. 1 is a plan view of a blank for forming a leak proof container.

Referring to FIG. 1, a die cut blank 10 is shown for illustrating one or more aspects of a container or tray comprising a leak resistant container, as described herein. In a use of the blank 10 to form a one-piece leak proof container 8, see FIG. 5, the blank 10 may be formed of a corrugated cardboard material having an interior portion defined by elongated flutes, generally designated F in FIG. 1, as is generally known in the art, and may be die cut to the shape shown herein, although other materials and variations of the illustrated shape may be provided within the scope of the container described herein. The blank 10 illustrated in FIG. 1 is a planar piece of material in which an inner side 12 is shown facing out of the page and an outer side 14, see FIG. 2, faces in an opposite direction from the inner side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral edges, generally designated 20 and 22, respectively. It may be noted that the flutes F extend in the lateral direction $L_2$.

The blank 10 comprises a bottom panel 24 having a plurality of peripheral edges $\mathbf{24}_1$, $\mathbf{24}_2$, $\mathbf{24}_3$, $\mathbf{24}_4$. A first side panel 26 is connected to the bottom panel 24 along a score line at the lateral peripheral edge $\mathbf{24}_3$, and a second side panel 28 is connected the bottom panel 24 along a score line at the opposing lateral peripheral edge $\mathbf{24}_4$. The peripheral edges $\mathbf{24}_1$, $\mathbf{24}_2$, $\mathbf{24}_3$, $\mathbf{24}_4$ define lower edges of the erected container 8.

First and second end portions 30*a*, 30*b* are located at the opposing longitudinal ends 16, 18 of the blank 10. Each end portion 30*a*, 30*b* includes a respective first and second inner end panels 32*a*, 32*b* connected to the longitudinal peripheral edges $\mathbf{24}_1$, $\mathbf{24}_2$ of the bottom panel 24 and extending between the lateral peripheral edges $\mathbf{24}_3$, $\mathbf{24}_4$. The first inner end panel 32*a* can include an outer longitudinal edge defined by a hinge portion 34*a* defined by a double score line $\mathbf{34}a_1$, $\mathbf{34}a_2$, and the second inner end panel 32*b* can include a hinge portion 34*b* defined by a double score line $\mathbf{34}b_1$, $\mathbf{34}b_2$. It should be understood that the inner end panels 32*a*, 32*b* may alternatively comprise hinge portions 34*a*, 34*b* defined by a single score line $\mathbf{34}a_1$, $\mathbf{34}b_1$.

The end portions 30*a*, 30*b* further include respective first and second outer end panels 36*a*, 36*b*. The first outer end panel 36*a* is hingedly joined to the first inner end panel 32*a* at the hinge portion 34*a*, and the second outer end panel 36*b* is hingedly joined to the second inner panel 32*b* at the hinge portion 34*b*. An inner longitudinal edge of the first outer end panel 36*a* can be connected to the first inner end panel 32*a* at the hinge portion 34*a*, and an outer longitudinal edge 16*a* of the first outer end panel 36*a* corresponds to the first longitudinal end 16 of the blank 10. An inner longitudinal edge of the second outer end panel 36*b* can be connected to the second inner end panel 32*b* at the hinge portion 34*b*, and an outer longitudinal edge 18*a* of the second outer end panel 36*b* corresponds to the second longitudinal end 18 of the blank 10. The first and second outer end panels 36*a*, 36*b* can be formed with a longitudinal dimension $D_1$ that is substantially less than a longitudinal dimension $D_2$ of the first and second inner end panels 32*a*, 32*b*.

The first end portion 30*a* additionally includes first and second corner panels 38*a*, 38*b* having inner longitudinal edges connected to the respective first and second side panels 26, 28 at score lines 39$a_1$, 39$b_1$ collinear with the longitudinal peripheral edge 24$_1$, and connected to the first inner end panel 32*a* at respective score lines 39$a_2$, 39$b_2$ collinear with the lateral peripheral edges 24$_3$, 24$_4$. The first and second corner panels 38*a*, 38*b* can each be formed with a square configuration having respective outer longitudinal edges 39$a_3$, 39$b_3$ collinear, or generally collinear with the outer longitudinal edge of the first inner end panel 32*a*, e.g., at the score line 34$a_1$, and having outer lateral edges 39$a_4$, 39$b_4$ collinear with the first and second lateral edges 20, 22, respectively. The first corner panel 38*a* additionally includes a score line defining a respective gusset fold line 38$a_f$ extending diagonally across the corner panel 38*a* from an inner corner defined at an intersection of the score lines 39$a_1$ and 39$a_2$ to an intersection of the outer longitudinal edge 39$a_3$ and outer lateral edge 39$a_4$. Similarly, the second corner panel 38*b* additionally includes a score line defining a respective gusset fold line 38$b_f$ extending diagonally across the corner panel 38*b* from an inner corner defined at an intersection of the score lines 39$b_1$ and 39$b_2$ to an intersection of the outer longitudinal edge 39$b_3$ and outer lateral edge 39$b_4$ The diagonal fold lines 38$a_f$, 38$b_f$ divide the first and second corner panels 38*a*, 38*b* into first and second triangular gusset panels 38$a_1$, 38$a_2$ and 38$b_1$, 38$b_2$, respectively.

The second end portion 30*b* additionally includes first and second corner panels 38*c*, 38*d* having inner longitudinal edges connected to the respective first and second side panels 26, 28 at score lines 39$c_1$, 39$d_1$ collinear with the longitudinal peripheral edge 24$_2$, and connected to the first inner end panel 32*b* at respective score lines 39$c_2$, 39$d_2$ collinear with the lateral peripheral edges 24$_3$, 24$_4$. The first and second corner panels 38*c*, 38*d* can each be formed with a square configuration having respective outer longitudinal edges 39$c_3$, 39$d_3$ collinear, or generally collinear with the outer longitudinal edge of the second inner end panel 32*b*, e.g., at the score line 34$b_1$, and having outer lateral edges 39$c_4$, 39$d_4$ collinear with the first and second lateral edges 20, 22, respectively. The first corner panel 38*c* additionally includes a score line defining a respective gusset fold line 38$c_f$ extending diagonally across the corner panel 38*c* from an inner corner defined at an intersection of the score lines 39$c_1$ and 39$c_2$ to an intersection of the outer longitudinal edge 39$c_3$ and outer lateral edge 39$c_4$. Similarly, the second corner panel 38*d* additionally includes a score line defining a respective gusset fold line 38$d_f$ extending diagonally across the corner panel 38*d* from an inner corner defined at an intersection of the score lines 39$d_1$ and 39$d_2$ to an intersection of the outer longitudinal edge 39$d_3$ and outer lateral edge 39$d_4$ The diagonal fold lines 38$c_f$, 38$d_f$ divide the first and second corner panels 38*c*, 38*d* into first and second triangular gusset panels 38$c_1$, 38$c_2$ and 38$d_1$, 38$d_2$, respectively.

Figure 2:
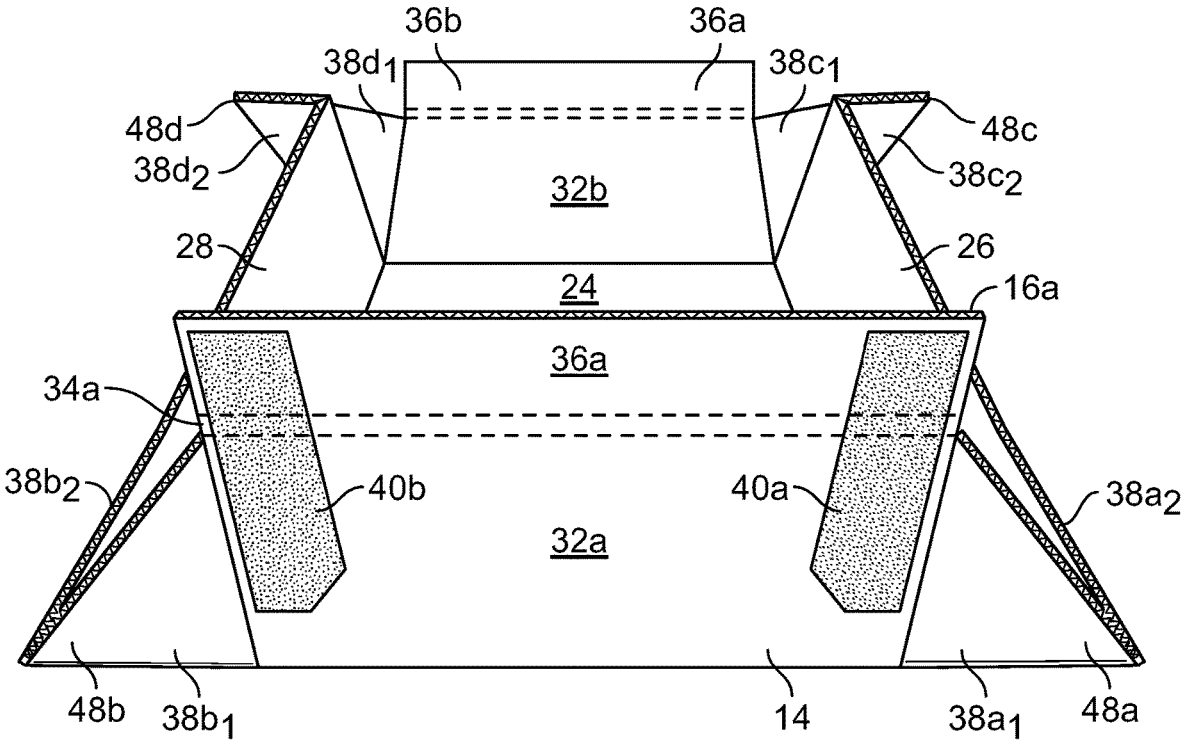
FIG. 2 is a perspective view of an initial step in folding the blank to erect the leak proof container.
Figure 3:
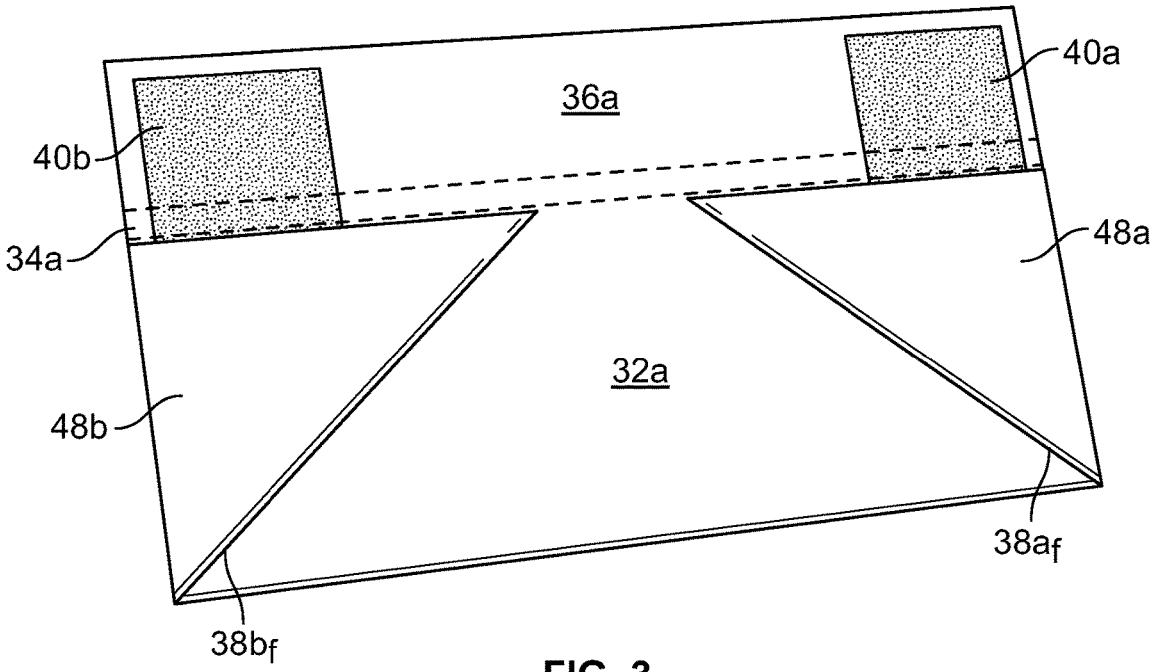
FIG. 3 is an elevation view illustrating a partially erected end portion and depicting a step of folding of gussets over an inner end panel.

Further, in accordance with an aspect for a machine erected container using the blank 10, each end portion 30*a*, 30*b* can include an adhesive area 40 associated with the outer side 14 of the blank 10. Referring to FIGS. 1 and 2, the adhesive area 40 at each end portion 30*a*, 30*b* can comprise first and second laterally spaced adhesive areas 40*a*, 40*b* that extend across at least a portion of respective outer and inner end panels 36*a*, 32*a* and 36*b*, 32*b*. In particular, each adhesive area 40*a*, 40*b* may comprise a strip of adhesive material extending from a longitudinal edge 16*a*, 18*a* on the outer side of a respective outer end panel 36*a*, 36*b*, and may extend to a location on a respective inner end panel 32*a*, 32*b* where a longitudinal inner edge 46 of the adhesive area 40*a*, 40*b* is spaced from a respective inner longitudinal edge of the inner end panel 32*a*, 32*b*, i.e., as defined at peripheral edges 24$_1$, 24$_2$. The adhesive areas 40*a*, 40*b* extend continuously, or generally continuously, longitudinally from the outer end panel 36*a*, 36*b* to the inner end panel 32*a*, 32*b*.

As is exemplified by the adhesive areas 40*a*, 40*b* on the first end portion 30*a*, each adhesive area 40*a*, 40*b* includes an outer lateral edge 42 located adjacent to respective lateral edges 36$a_1$, 36$a_2$ of the outer end panel 36*a*, and located adjacent to respective lateral edges of the first inner end panel 32*a*, i.e., at the score lines 39$a_2$, 39$b_2$. The adhesive areas 40*a*, 40*b* further include respective inner lateral edges 44 that may be parallel or generally parallel to the outer lateral edges 42. Similarly, the adhesive areas 40*a*, 40*b* on the second end portion 30*b* are located adjacent to lateral edges 36$b_1$, 36$b_2$ of the second outer end panel 36*b*, and located adjacent to respective lateral edges of the inner end panel 32*b*, i.e., at the score lines 39$c_2$, 39$d_2$.

Each adhesive area 40*a*, 40*b* can include an angled corner 47 defined between the inner longitudinal edge 46 of each adhesive area 40*a*, 40*b* and a respective inner lateral edge 44. The angled corner 47 forms an obtuse angle extending from the inner lateral edge 44. However, it should be understood that the adhesive area 40, e.g., the adhesive areas 40*a*, 40*b*, may cover additional or less area, and may have other shapes, than is described and illustrated herein. For example, and without limitation, the adhesive area 40 may extend across substantially the entire lateral area of the outer end panel 36*a*, 36*b*, and may extend over substantially an entire area of the inner end panel 32*a*, 32*b* that is overlapped by gussets formed by the corner panels 38*a*, 38*b*, 38*c*, 38*d*, as is described further below.

Referring to FIGS. 2-5 a method of forming the blank 10 into an erected container 8 is described, wherein it should be understood that the method of forming the erected container 8 may be machine implemented, as is facilitated by the described configuration for the blank 10. Additionally, it may be noted that the machine implemented forming operation can include providing the adhesive area 40 as an application of hot melt glue applied as a final step in forming or preparing the blank 10, which can also comprise an initial step of the container forming operation.

The side panels 26, 28 and inner end panels 32*a*, 32*b* are initially folded upward from the bottom panel 24. Simultaneously, the corner panels 38*a*, 38*b*, 38*c*, 38*d* can be folded about respective gusset fold lines 38$a_f$, 38$b_f$, 38$c_f$, 38$d_f$ to define gussets 48*a*, 48*b*, 48*c*, 48*d*, see FIG. 2, and the gussets 48*a*, 48*b*, 48*c*, 48*d* can be folded perpendicular to a respective side panel 26, 28 into overlapping relationship with an inner end panel 32*a*, 32*b*, as illustrated by gussets 48*a*, 48*b* in overlapping relationship with the inner end panel 32*a* in FIG. 3, it being understood that a similar operation can be performed, either simultaneously or subsequently, at the opposing end portion 30*b* to position the gussets 48*c*, 48*d* in overlapping relationship with the inner end panel 32*b*. As the gussets 48*a*, 48*b*, 48*c*, 48*c* are folded into overlapping relationship with the inner end panels 32*a*, 32*b*, the gussets 48*a*, 48*b*, 48*c*, 48*d* are also brought into engagement with the portion of the adhesive area 40, e.g., the adhesive areas 40*a*, 40*b*, on the inner end panels 32*a*, 32*b* to retain the gussets 48*a*, 48*b*, 48*c*, 48*d* in engagement on the inner end panels 32*a*, 32*b*. The angled corners 47 of the adhesive areas 40*a*, 40*b* can provide a contour of the adhesive areas 40*a*, 40*b* that is generally parallel to and closely adjacent to respective gusset fold lines $38a_f$, $38b_f$, $38c_f$, $38d_f$.

Figure 4:
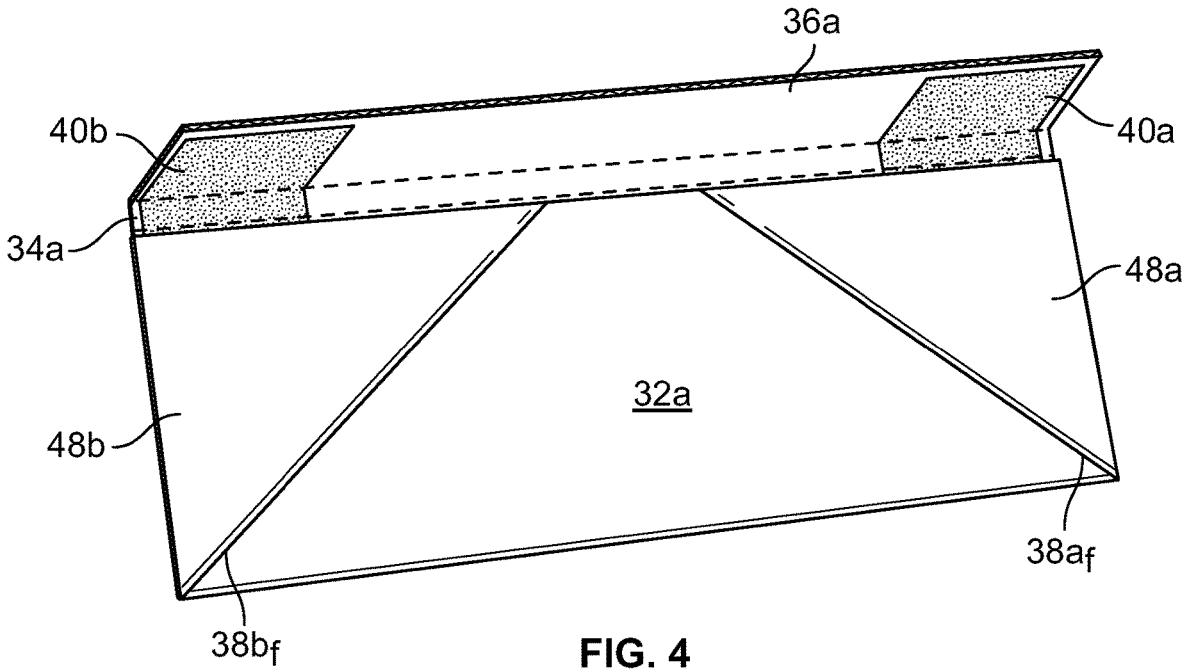
FIG. 4 is a view similar to FIG. 3 illustrating an initial folding of an outer end panel toward overlapping relation with the gussets and the inner end panel.
Figure 5:
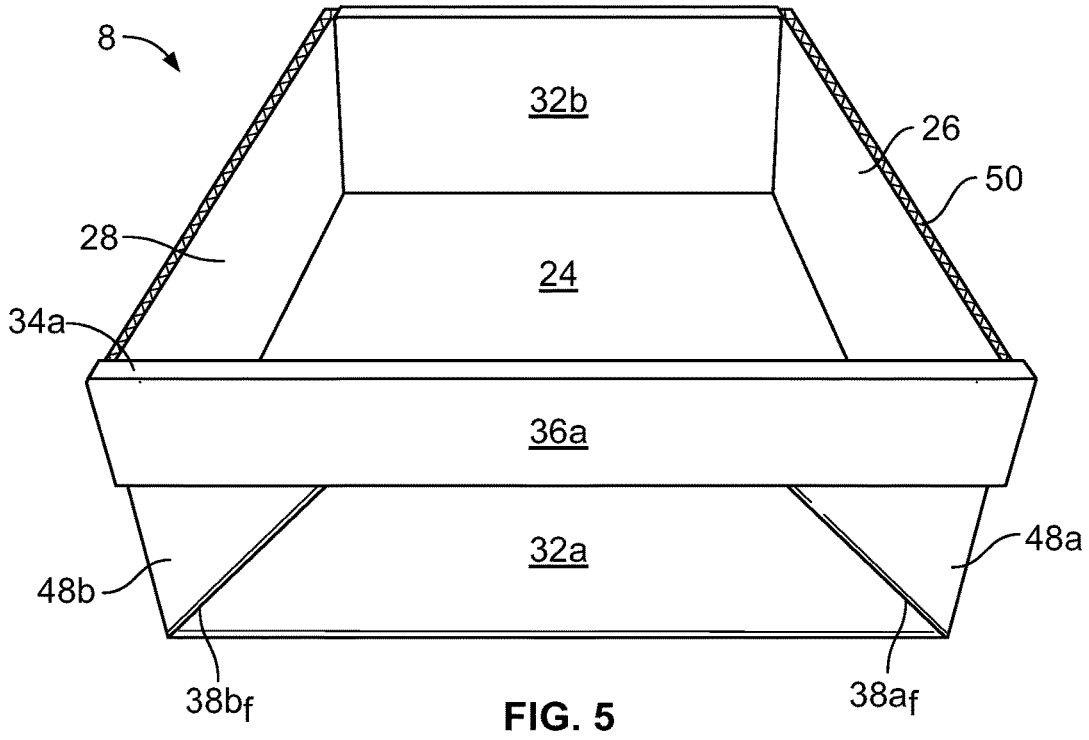
FIG. 5 is a perspective view of the erected leak proof container.

The outer end panels 36*a*, 36*b* are subsequently pivoted outwardly about the inner longitudinal edge, i.e., at the hinge portions 34*a*, 34*b*, as is illustrated by the partially pivoted outer end panel 36*a* in FIG. 4. Pivoting or folding the outer end panels 36*a*, 36*b* positions the outer end panels 36*a*, 36*b* in overlapping relationship over the respective gussets 48*a*, 48*b*, 48*c*, 48*d*, and positions the adhesive area 40 on the outer end panels 36*a*, 36*b* in engagement with at least a portion of the gussets 48*a*, 48*b*, 48*c*, 48*d* to further secure the gussets 48*a*, 48*b*, 48*c*, 48*d* in position and form a rigid structure for the ends of the container 8, as seen in FIG. 5. Hence, providing the adhesive area 40 as a continuous area extending from the outer end panel 36*a*, 36*b* to the inner end panel 32*a*, 32*b* provides an efficient application of adhesive that is used to adhere the gussets 48*a*, 48*b*, 48*c*, 48*d* to both the inner and outer end panels 32*b*, 32*a* and 36*a*, 36*b*.

The configuration formed by the folded gussets 48*a*, 48*b*, 48*c*, 48*d* defines folded container corners that form a continuous connection between the side panels 26, 28 and the inner end panels 32*a*, 32*b* extending from the bottom panel 24 to an upper edge 50, see FIG. 5, of the container 8. Hence, the continuous configuration formed by the gussets 48*a*, 48*b*, 48*c*, 48*d* can prevent or substantially limit fluids from leaking out of the container 8 at junctions between the side panels 26, 28 and the inner end panels 32*a*, 32*b*.

It may be noted that the outer longitudinal edges 16*a*, 18*a* of the outer end panels 36*a*, 36*b* may be located in vertically spaced relation from the bottom 24 of the container, i.e., the peripheral edges $24_1$, $24_2$. For example, the outer end panels 36*a*, 36*b* may extend less than approximately half-way down the inner end panels 32*a*, 32*b* to reduce the material required for the outer end panel material. That is, the dimension $D_1$ can be less than half the dimension $D_2$, see FIG. 1.

The inner end panel 32*b*, outer end panel 36*b*, and gussets 48*c*, 48*d* forming the opposing end of the container 8 can be folded in manner similar to that described above for the inner end panel 32*a*, outer end panel 36*a*, and gussets 48*a*, 48*b* to form the completed container 8, as illustrated in FIG. 5. While the described blank 10 and container 8 provides a configuration that can be readily assembled in a machine implemented folding operation, it may be understood that the blank 10 can also be erected into the container utilizing a manual operation or a combination of machine and manual implemented operations. Also, it should be understood that, although a hot melt glue is described as an adhesive for the adhesive area 40, other adhesive materials may be provided for the adhesive area 40.

Also, it should be noted that, although the described construction of the container presents the gussets 48*a*, 48*b*, 48*c*, 48*d* being folded outward of the container, the gussets 48*a*, 48*b*, 48*c*, 48*d* may alternatively be folded inward to overlap respective inner sides of the inner end panels 32*a*, 32*b* and the outer end panels 36*a*, 36*b* may be folded inward. In such an alternative folding operation, the adhesive area 40 would be applied to the inner surface 12 of the inner and outer end panels 32*b*, 32*a* and 36*a*, 36*b*.

It may be understood that, the blank 10 described herein may be formed having a clean outside perimeter, with straight cuts, including straight common knife areas, and no internal trim areas, without additional features such as cutouts or slots, such that the potential for trim debris created from such cutouts or slots is avoided. Hence, the configuration of the blank 10 and resulting container 8 can provide a container for food products that can avoid or substantially reduce contamination as a result of eliminating internal scrap areas, for example, eliminating the release of debris from the blank structure and/or when scrap is released but falls in between plural containers as they are stacked or otherwise grouped together.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for making a leak proof container, the blank having an inner side and an outer side and comprising:

a bottom panel having a plurality of peripheral edges;

first and second side panels connected to the bottom panel at opposing lateral peripheral edges and defining lower edges of the container;

first and second end portions located at opposing longitudinal ends of the blank, each end portion including:

an inner end panel connected to a longitudinal peripheral edge of the bottom panel;

an outer end panel having an inner longitudinal edge hingedly connected to a longitudinal edge of the inner end panel;

first and second corner panels, each corner panel having a longitudinal edge connected to a respective one of the first and second side panels and a lateral edge connected to a lateral edge of the inner end panel; and an adhesive area located on one side of the blank and comprising at least a portion on each of the outer end panel and the inner end panel, wherein the adhesive area extends longitudinally generally continuously from the outer end panel to the inner end panel.

2. The blank as set forth in claim 1, wherein the adhesive area comprises first and second laterally spaced adhesive areas.

3. The blank as set forth in claim 2, wherein the first and second adhesive areas include outer lateral edges located adjacent to respective lateral edges of the outer end panels and adjacent to respective lateral edges of the inner end panels.

4. The blank as set forth in claim 3, wherein the adhesive areas each include an inner lateral edge, parallel to the outer lateral edges of the adhesive areas, and an inner longitudinal edge having at least a portion defining an angled corner forming an obtuse angle extending from a respective inner lateral edge.

5. The blank as set forth in claim 2, wherein the first and second adhesive areas extend longitudinally generally continuously from the outer end panel to the inner end panel.

6. The blank as set forth in claim 2, wherein the adhesive areas are defined by an application of hot melt glue.

7. The blank as set forth in claim 1, wherein the corner panels are formed as square panels, and including a diagonal fold line dividing each corner panel into first and second triangular gusset panels.

8. The blank as set forth in claim 7, wherein each corner panel includes a lateral edge that is colinear with a lateral edge of the blank defined by an edge of one of the first and second side panels.

9. The blank as set forth in claim 1, wherein a longitudinal dimension of the outer end panel is substantially less than a longitudinal dimension of the inner end panel.

10. The blank as set forth in claim 1, wherein the adhesive area is located on the outer side of the blank.

11. The blank as set forth in claim 1, wherein the adhesive area is located on the inner side of the blank.

12. The container as set forth in claim 1, wherein a gusset fold line extends from the bottom of the container to the inner longitudinal edge of the outer end panel.

* * * * *